US005799340A

United States Patent [19]

Hubrig et al.

[11] Patent Number: 5,799,340

[45] Date of Patent: Sep. 1, 1998

[54] WATER-CONSERVING URINAL

[76] Inventors: Sylvan E. Hubrig, 10734 Hutton Dr., Sun City, Ariz. 85351; Roy K. Fischer, 12646 N. 56th Pl., Scottsdale, Ariz. 85254

[21] Appl. No.: 751,857

[22] Filed: Nov. 18, 1996

Related U.S. Application Data

[63] Continuation-in-part of Ser. No. 390,103, Feb. 17, 1995, Pat. No. 5,575,020.

[51] Int. Cl.[6] ..... E03D 1/22

[52] U.S. Cl. ..... 4/342

[58] Field of Search ..... 4/144.1, 144.3, 4/301, 340–342

[56] References Cited

U.S. PATENT DOCUMENTS 3,568,219 3/1971 Roberts ..... 4/483

4,145,768 3/1979 Chevrette ..... 4/144.1

4,750,219 6/1988 Williams ..... 4/301

*Primary Examiner*—Charles E. Phillips

*Attorney, Agent, or Firm*—Gregory J. Nelson

[57] ABSTRACT

A uni-sex water conserving urinal which has a bowl which is engageable with a hanger on or near the toilet. A flush plate directs water into the bowl. In use, the bowl is detached and moved to a position of use which is permitted by the flexible waste and water supply line. The water supply is from a reservoir in the hanger. The reservoir may include a pump for manually pressurizing the flushing water. Flush water may be supplied by manually filling the reservoir or by connecting the reservoir across a valve to a water supply. A universal connector may be used to connect the waste line from the bowl into an existing drain line.

8 Claims, 7 Drawing Sheets

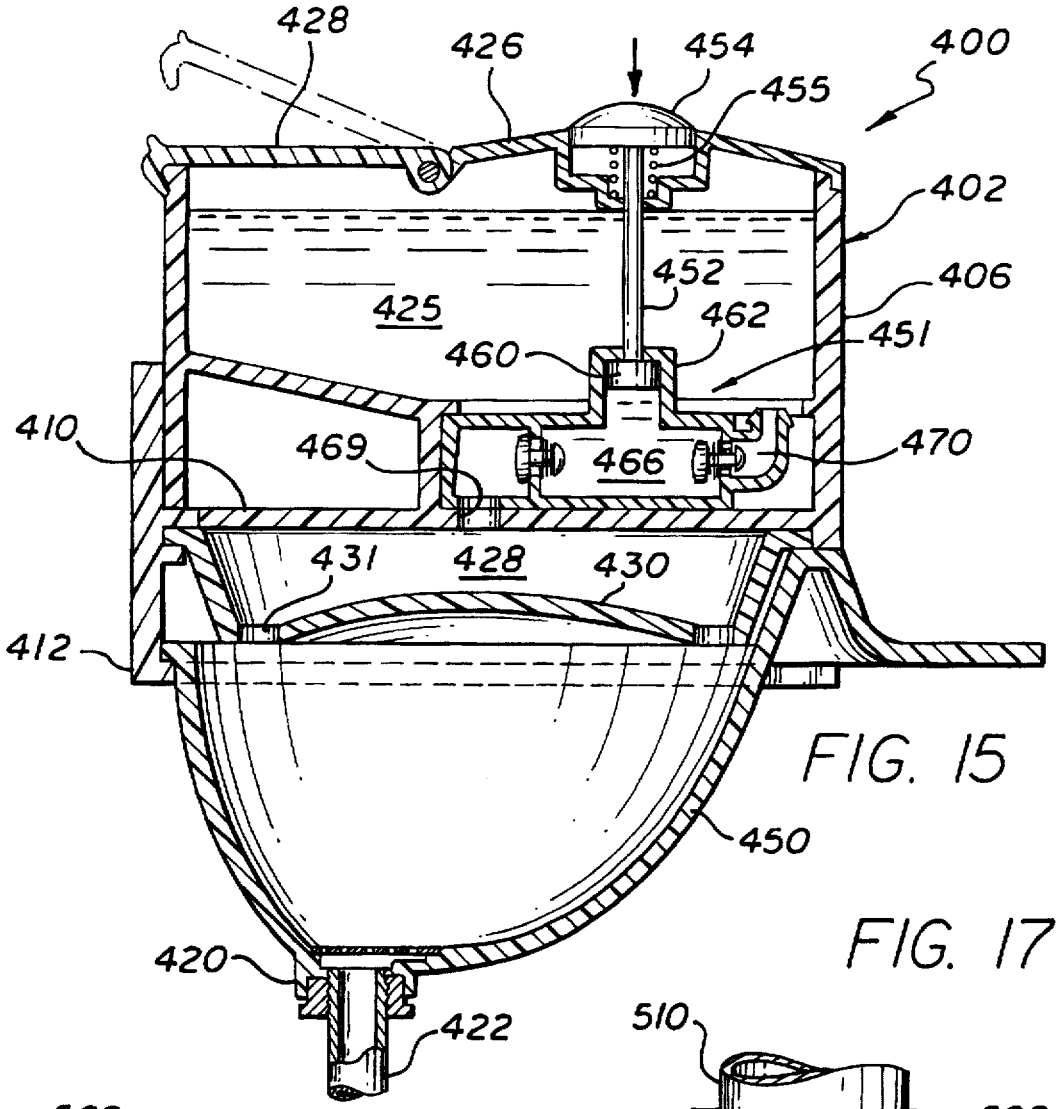
FIG. 15
FIG. 17
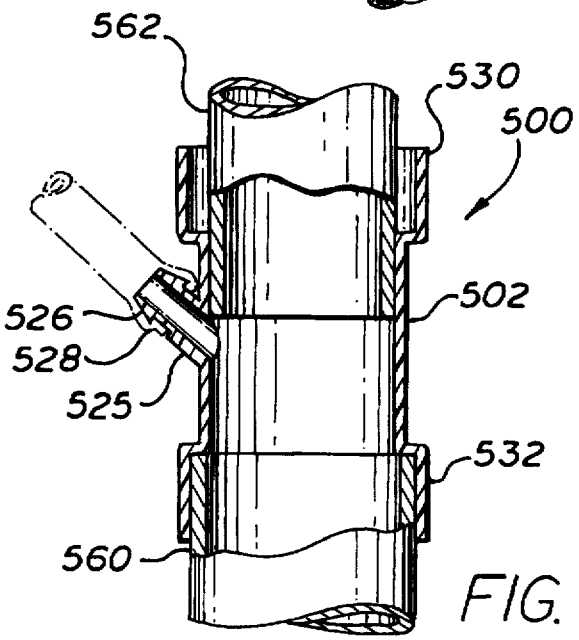
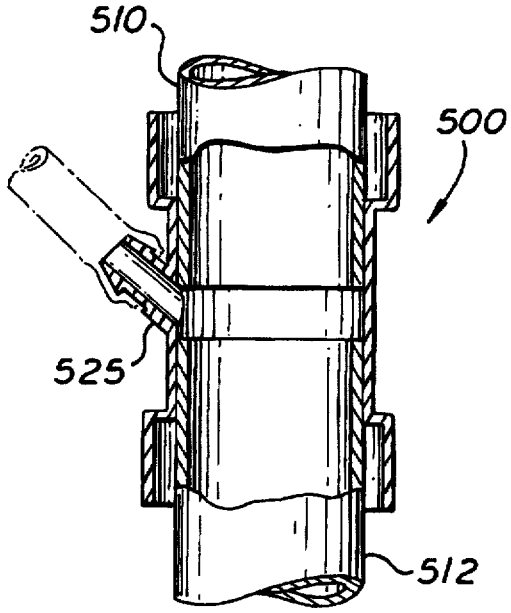
FIG. 16

WATER-CONSERVING URINAL

CROSS-REFERENCE TO PRIOR RELATED APPLICATION

This application is a continuation-in-part of application Ser. No. 08/390,103 filed on Feb. 17, 1995, now U.S. Pat. No. 5,575,020.

FIELD OF THE INVENTION

The present invention relates to plumbing fixtures and more particularly relates to a urinal which is adapted for use by both men and women and which urinal provides convenience and significant water savings.

BACKGROUND OF THE INVENTION

The conventional toilet discharges approximately between 1.6 and 5 gallons of water into the toilet bowl and sewer when it is flushed. Recently, consistent with the recognition of a need for water conservation, toilets have been designed which utilize less volume of water by incorporating water saving devices such as valves which achieve negative buoyancy so that the valve is closed prior to discharge of the entire contents of the toilet tank. However, even with such low water consumption devices, the normal flushing operation will discharge over one gallon of water per flush into the sewer. While this quantity of water may be necessary for flushing some materials such as fecal matter and paper, this quantity of water is in excess of the amount normally required for proper flushing of urine.

Apart from the problem of water conservation, conventional toilet design does not provide the convenience and expediency of a urinal. It is not uncommon, particularly at public facilities, for long lines to form at rest rooms. This is particularly true at women's rest rooms because women's rest rooms do not provide convenient urinals of the type found in men's rest rooms. Accordingly, there exists a need for an improved urinal which provides convenience of use.

THE PRIOR ART

The prior art discloses a number of urinal attachments for toilet bowls. For example, U.S. Pat. No. 3,412,408 discloses a bowl-like urinal adjustably positionable and attachable to a toilet. The device has a flexible, disposable drain duct which discharges into the toilet bowl. While the device shown in this patent is convenient for use by men, it is not generally suitable for use by women and does not result in water savings since the contents are discharged into the toilet bowl requiring a full cycle flushing operation.

U.S. Pat. No. 4,145,768 discloses a water conserving urinal having an open top funnel which can be mounted on a wall adjacent the toilet with a flexible hose extending from the funnel to the U-shaped gas trap section of an adjacent sink or water basin.

U.S. Pat. No. 4,282,611 discloses a urinal adapted for attachment to a toilet bowl which has a bracket arm connected to the toilet seat anchor bolts and which device extends laterally of the toilet bowl. A swing arm is pivotally connected to the bracket arm and supports a funnel. In the use-position, the funnel and stem are in registry with the toilet bowl and in the non-use position they are pivoted or swung out of registry with the toilet bowl. Again, while the device provides the convenience of a urinal, it does not result in water savings and the device also has certain sanitary concerns in that in the non-use position, urine not drained from the device could easily drip onto the floor, wall or toilet.

U.S. Pat. No. 4,985,940 shows a plumbing fixture for installation in women's rest rooms. An elongate, flexible hose has a funnel at its top and communicates with a water-holding bowl that is flushed by a siphoning action. A sanitary cuff extends around the rim of the funnel so that the funnel does not contact the user. The cup is removed from the funnel after use by an ejector arm when the funnel is placed between the arms of a hanger member.

U.S. Pat. No. 5,153,947 shows a urinal attachment for a floor-mounted toilet. The urinal has a bowl adjacent the toilet and an outlet in the bowl connects to a drain line fitting which attaches to the toilet base. The drain line of the urinal bowl is connected to a drain fitting so that it bypasses the toilet bowl and yet is periodically rinsed by a water line. Use of this device could result in noxious odors from the drain pipe being communicated to the rest room by means of the device.

U.S. Pat. No. 4,683,598 shows a urinal adapted for use by females which has a flexible tube with a flared upper end shaped to conveniently fit the female anatomy and collect urine which drains down through a flexible line to a collection bowl. The collection bowl may be located on a floor or against a wall.

U.S. Pat. No. 4,137,579 discloses a plumbing fixture having a receptacle with a tube forming a P-trap at its lower end. The P-trap is coupled to a standard toilet by an expandable grommet. The receptacle has a hollow handle which serves as a water distribution control means to supply water to a tubular hollow rim of the receptacle. An eye is provided as part of the receptacle to enable the device to be hung in a storage position between uses.

Co-pending patent application, now U.S. Pat. No. 5,390,374, discloses an improved water-conserving urinal for both males and females which is attachable to the toilet. The urinal bowl is supported on a flexible member secured at its lower end to a pivot member. Water is supplied to the bowl from the toilet water supply line via flexible supply line. A flush valve is provided in the water line and distributes a low volume of water around the bowl by means of an interiorly located flush ring. A waste line extends from the discharge of the urinal bowl to the sewer. Fluid waste is discharged directly to the sewer line without the necessity of a full flush of the toilet resulting in substantial water savings. The pivoted flexible support permits the urinal to be moved forward to the desired position and height to accommodate the requirements of the user.

Therefore, while the above devices and others which may be found in the prior art due to some extent provide convenience of a urinal and also provide water saving features, there nevertheless exists a need for an improved urinal which will result in water savings and which is adaptable for use by both men and women and which device is both functionally and aesthetically acceptable.

SUMMARY OF THE INVENTION

Accordingly, it is a broad object of the present invention to provide a water conserving urinal assembly which is convenient and is adapted for use by both men and women.

It is another object of the present invention to provide a urinal which may be conveniently mounted to existing toilet bowls or attached to existing plumbing fixtures.

Another object of the present invention is to provide a urinal which may be used in either private residential or public rest rooms.

It is another object of the present invention to provide a urinal which results in substantial savings of water.

Another object of the present invention is to provide a urinal which is mounted to a toilet bowl or to an area adjacent the toilet to provide convenience of use and which permits the device to be stored in a convenient, out-of-the-way position.

Another object of the present invention is to provide a urinal which may be plumbed to a conventional toilet or other waste line and which discharges directly into the sewer.

Another object of the present invention is to provide a urinal having a protective cover to which the urinal may be attached in a stored position.

SUMMARY OF THE INVENTION

Briefly, in accordance with a preferred embodiment of the present invention, a urinal is provided which includes a urinal bowl which is attached to a flexible waste line. The waste line may be connected to a sewer line through a fitting at the base or pedestal of the toilet or may be directly attached to a drain line of a plumbing fixture such as a wash basin. A flexible waste line may also be extended through the toilet bowl into the waste or sewer line to drain directly into the sewer line when flushed without the necessity of flushing the toilet and without special plumbing requirements.

The urinal bowl is detachably securable at a hanger which may be attached to the toilet tank or attached at a convenient location such as to the wall adjacent the toilet. The hanger has receiving channels which will engage the bowl in the stored position and which permit the bowl to be disengaged from the hanger when used. The hanger also provides a cover over the bowl in the stored position and includes a flush ring which is attached to a source of flush water. A flush valve is operated to discharge water into the attached bowl when necessary. Preferably, the flush valve is actuated by a button located on the cover. The source of water may be the toilet tank, in which case the flush water line depends into the toilet tank and into a filter reservoir. The source of flush water may also be an existing water line such as the filler line supplying the flush tank in which case it is necessary to provide a connection into the water line.

In the preferred embodiment, the urinal bowl has a narrow front edge and diverges rearwardly having a general triangular or keyhole shape. This configuration facilitates convenient use both by men and women.

In another embodiment, the urinal bowl has an integral cover which is pivotally attached to the bowl and is spring biased to a closed position. Moving the cover to an open position and allowing it to return to a closed position will actuate a flush valve directing water into the bowl.

BRIEF DESCRIPTION OF THE DRAWINGS

The above and other objects and advantages of the present invention will become more apparent from the following description, claims and drawings in which:

FIG. 13A is a detail cross-sectional view of an alternate fill valve;

FIG. 15 is a cross-sectional view of another embodiment of the urinal of the present invention.

FIGS. 16, and 17 are cross-sectional views of a waste line connector for attachment in a conventional waste water or drain line as seen connected to the waste line in FIG. 11.

DESCRIPTION OF THE PREFERRED EMBODIMENT

Figure 1:
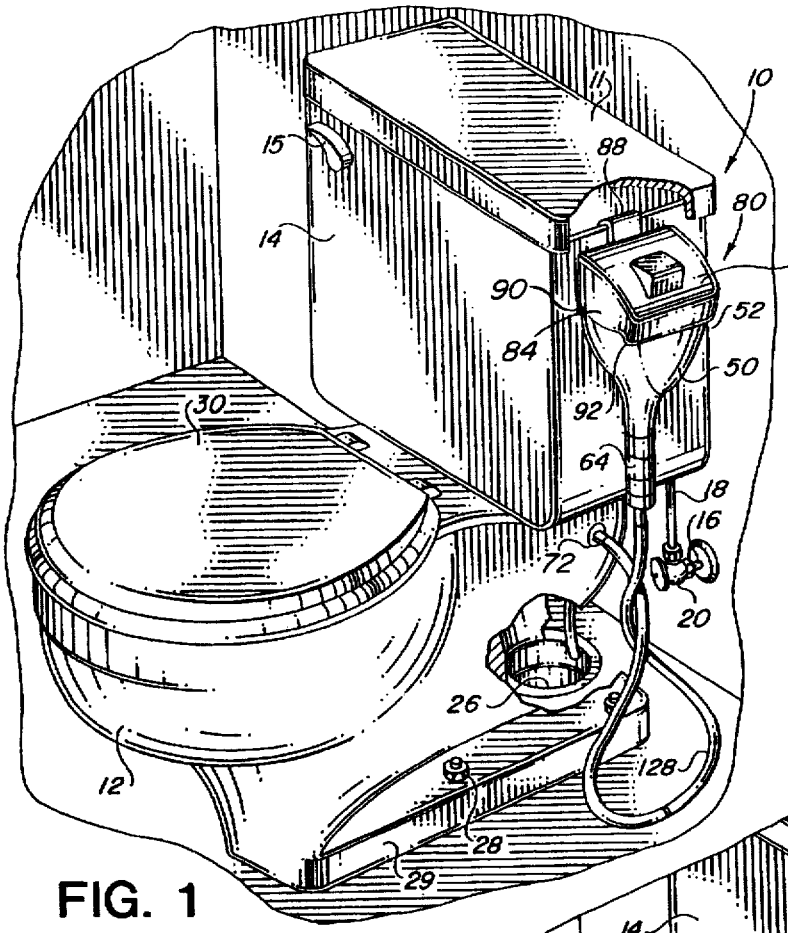
FIG. 1 is a perspective view showing a preferred form of the urinal of the present invention attached to a conventional toilet with the urinal shown in a stored position.

Turning to the drawings, FIGS. 1 to 4 show a preferred form of the present invention which is generally designated by the numeral 10 and is shown in conjunction with a conventional toilet which has a toilet bowl 12 and a tank 14 with a cover 11. The tank is supplied with water by means of a water line 16 and filler line 18. A conventional shut-off valve 20 is provided in the water line 16. The water in tank 14 may be selectively discharged into the toilet bowl by operation of a trip handle 15 which will lift the ball or other valve member from the valve seat within the bottom of the tank allowing the water to be discharged into the toilet bowl and across the trap section 22 of the toilet into the sewer line 26. The toilet is secured to the floor by a plurality of hold down nuts 28 secured to bolts which extend through the flange 29 at the base of the toilet. As is conventional, the tank and the toilet bowl and are ceramic and the lid assembly 30 is secured to the toilet bowl by bolts at the rear of the seat assembly. The construction described above is conventional and is set forth to facilitate an understanding of the present invention as the present invention may be attached and used with conventional toilets of the type described.

Figure 2:
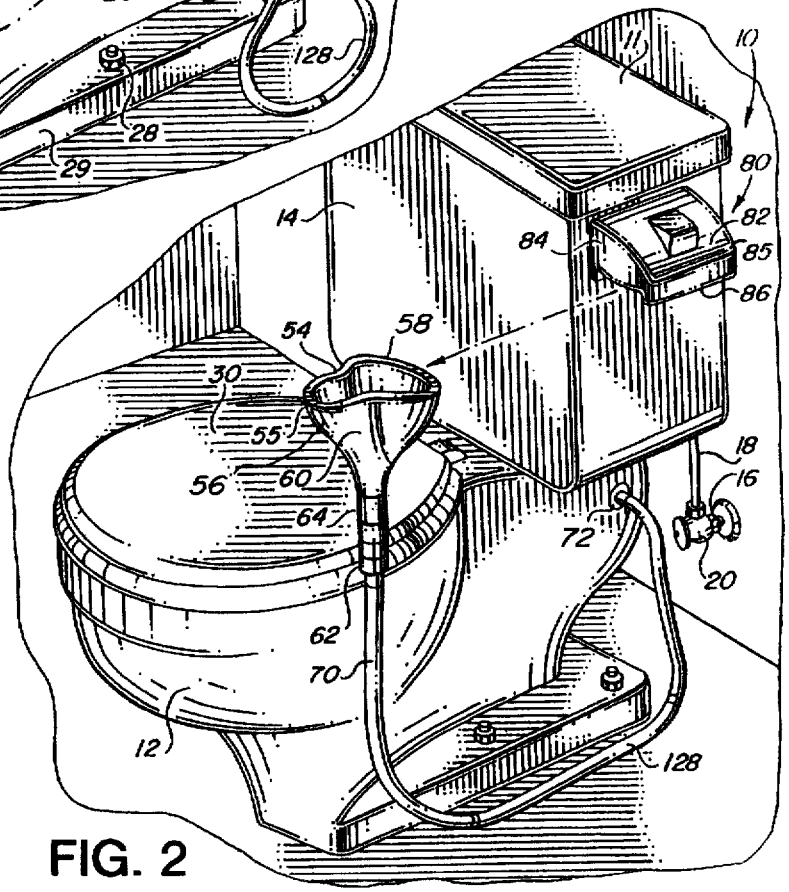
FIG. 2 is a view similar to FIG. 1 with the urinal shown removed from its stored position.

The urinal device 10 includes a bowl 50, as best seen in FIG. 2, which is preferably molded from a suitable rigid and chemically-resistant plastic such as PVC, ABS or the like. The bowl has a side wall 52 which terminates at an upper rim 54 having a bead or lip 55 extending at least partially around the rim. The bowl may be configured in various shapes but preferably is generally pyriform as shown having narrow front 56 which diverges into a larger rear section 58.

The bowl downwardly converges to a funnel portion 60 which terminates at a lower outlet 62. The lower end of the funnel is preferably formed as a cylindrical member 64 to provide a convenient surface for gripping by the user. One end of flexible waste line 70 communicates with the sewer line 26 at quick connect fitting 72. Quick connect fitting 72 is located in the base of the toilet communicating with the sewer line below the level of the water seal in the trap. Quick connect fitting 72 allows the flexible line 70 to be easily and quickly disconnected from the toilet, if required, for repair. The quick connect fitting can be either provided as a OEM component of the toilet or may be retrofit by drilling a hole through the base of the toilet at the appropriate location aligned with the sewer.

As seen in FIGS. 1 and 2, the bowl 50 is received or "parked" in a hanger 80 in the stored position. The hanger 80 has a downwardly curved top wall 82, a front wall 84, a rear wall 85 and a side wall 86. The hanger is suspended from the side wall of the toilet tank by a generally U-shaped hook 88. The rear wall 85 and the front wall 84 are provided with oppositely positioned, rearwardly extending flanges or channels 90 and 92. The flanges turn inwardly so as to engage the bead or lip 55 on the rear portion of the bowl. In this way, the bowl can be engaged in the hanger in the stored position as shown in FIG. 1 by aligning the upper rim of the bowl with the flanges 90, 92 and manually moving the bowl rearwardly until the bowl is in abutment against the rear wall 85 in the fully engaged and stored position. As indicated, area 64 is provided for convenient gripping of the bowl for removing the bowl and for returning it to the stored position. With the urinal bowl in the stored position, the hanger 80 serves as a cover over the urinal bowl for aesthetic, sanitary and functional reasons.

Figure 4:
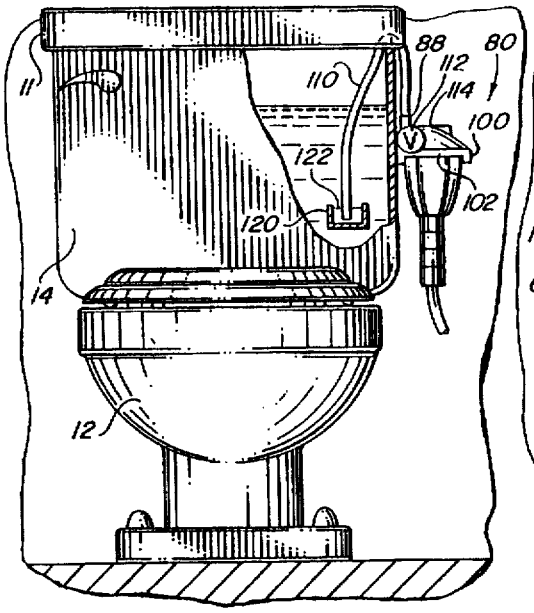
FIG. 4 is a front view of a toilet with the urinal attached and with a part of the tank broken away to illustrate use of the toilet tank reservoir as the flush water supply for the urinal and a part of the hanger broken away to illustrate the flush ring.

As best seen in FIG. 4, the hanger houses a flush ring 100 which flush ring is shaped to conform to the shape of the interior of the bowl. The flush ring is mounted within hanger 80 at a location above the rim of the bowl when the bowl is in the housed or stored position seen in FIG. 2. The flush ring is preferably molded of plastic tubing and has a plurality of spaced-apart nozzles 102 which serve to direct water downwardly and inwardly along the interior walls of the bowl. The flush ring may be fabricated as an integral part of the cover or may be separately fabricated and secured to the cover interior by appropriate fasteners.

Water supply line 110 connects to the flush ring across flush valve 112. Valve 112 is opened by depressing valve actuator button 114 which is centrally located on the cover 82. Depressing button 114 will allow water to flow into the flush ring and be discharged into the subjacent bowl 50 to flush and rinse the bowl.

Water supply line 110 is connected to the flush ring and is a flexible hose which extends between the tank cover 11 and the toilet tank 14 and depends into the toilet bowl as seen in FIG. 4. Hook 88 from which hanger 80 is suspended will space the tank cover 11 from the upper edge of the tank 14 a sufficient distance to provide clearance through which the water line 110 may extend. The inlet end of the line 110 terminates at a location above the floor of the tank depending into reservoir 120. Reservoir 120 is cup-shaped and may be molded plastic and is attached to the interior tank wall or may be attached to the end of the water inlet line 110. A filtering material 122 such as cellular foam may be placed within the reservoir.

When installed, the bowl is in the normal stored or "parked" position as shown in FIG. 1 which places it out of the way and positions the urinal bowl convenient for use. In this position, the urinal bowl is covered by the hanger 80 making it aesthetically acceptable and also sanitary. When it is desired to use the device, the user will grasp the urinal bowl about the handle 64 and pull the bowl forward so that it disengages from the hanger 80. The user then positions the urinal bowl at the desired use location which is accomplished due to the flexibility of waste line 60.

After use, the user will reinsert the urinal bowl into the hanger by engaging the bowl rim 55 with the flanges 90 and 92 and moving the bowl rearwardly until it is fully engaged within the hanger.

The urinal is flushed after each use by means of flush valve which is operated by button 114. A small quantity of water, typically a pint or less, will be admitted into the flush ring 100 and discharged directly into the bowl housed within the cover below the flush ring. The water is drawn from the supply within the toilet tank through the filter 122 and line 110 and into the flush ring due to the hydrostatic pressure that exists by virtue of the level of flush ring being located below the normal water level within the toilet tank. The reservoir 120 will maintain the "prime" of the line 110. The toilet tank will automatically replenish whatever water is lost due to flushing the urinal through the action of the float valve normally associated with the toilet tank. Odors are minimized because the urinal is covered when flushed. Odors are also prevented from flowing through discharge line 70 as it is normally looped adjacent the base of the toilet at 128 which will maintain a water seal preventing odors from passing upwardly from the sewer drain into the bowl.

After use, the bowl is returned to its stored position convenient for later use. The shape of the bowl 50 facilitates use both by males and females. An important aspect of the preferred embodiment is that the urinal does not require the toilet tank 14 to be flushed but rather only a small quantity of rinse water from the toilet tank is required. This is in contrast to normal toilet operation which normally uses between 1½ and 5 gallons of water per flush, resulting in substantial water savings.

Figure 5:
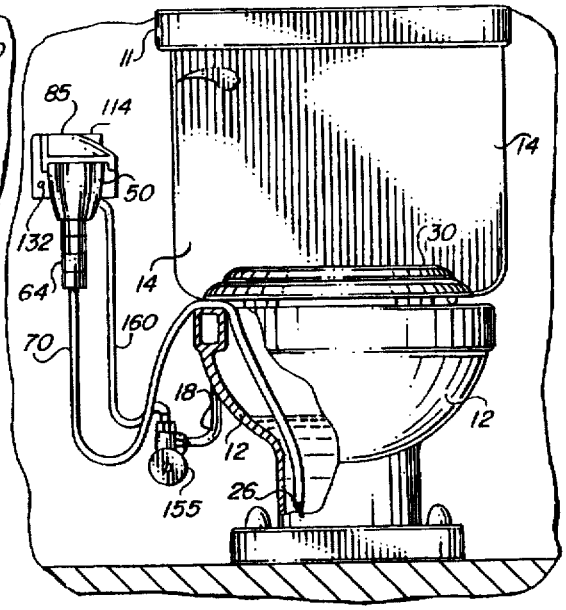
FIG. 5 is a front view of a toilet showing the urinal bowl attached to a wall adjacent the toilet and with the bowl connected to the water filler line.

In FIG. 5, an alternate embodiment of the present invention is shown again in conjunction with a conventional toilet having a toilet tank 14 and toilet bowl 12. For convenience, the same reference numerals are used throughout to identify the same or similar elements. The urinal bowl 50 is constructed as has been previously described having general overall funnel configuration terminating at a handle 64 with an outlet at the lower end of the handle. A flexible discharge line 70 connects the outlet and, as an alternative to the adaptation shown in FIG. 1, extends beneath the toilet lid assembly 30 depending through the P-trap of the toilet and directly into the sewer line 26. In this manner, no plumbing connections are required. In addition, the hanger 80 is as has been described with reference to FIG. 1 with a modification that the hanger has a rear wall 85. The rear wall 85 includes one or more holes 132 so that the hanger may be secured to a fixture such as the bathroom wall adjacent the toilet. The hanger 80 is as has been described above, provided with an internal flush ring through which water may be admitted across a valve by actuation of button 114. The flush valve is connected to a water supply by means of a tee 155 interposed in the filler line. One outlet of the tee connects to water line 160 which is flexible tubing. The water line 160 extends upwardly adjacent the rear and side wall of the toilet tank and is connected to an inlet 162 in hanger 80 connected to the flush ring across the valve. The flush valve, when operated, will allow water to flow through the flush ring to be discharged downwardly along the interior surface of the bowl.

The device shown in FIGS. 1 to 5 may be stored in a non-use position within the hanger 80 which reduces the possibility of emission of odors and also presents an aesthetically acceptable appearance. The device may be flushed passively using water from the toilet bowl as described above or, as shown, may also be connected to a pressurized water source such as the filler line which provides a supply of water to the toilet tank. In contrast to normal toilet operation, a very small amount of water is utilized.

Figure 7:
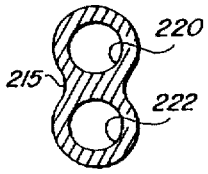
FIG. 7 is a sectional view taken along line 7—7 of FIG. 6.
Figure 3:
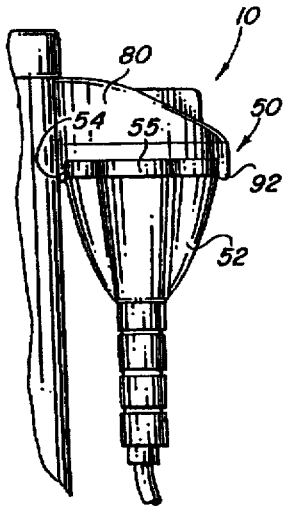
FIG. 3 is a front view of the urinal bowl and cover.
Figure 6:
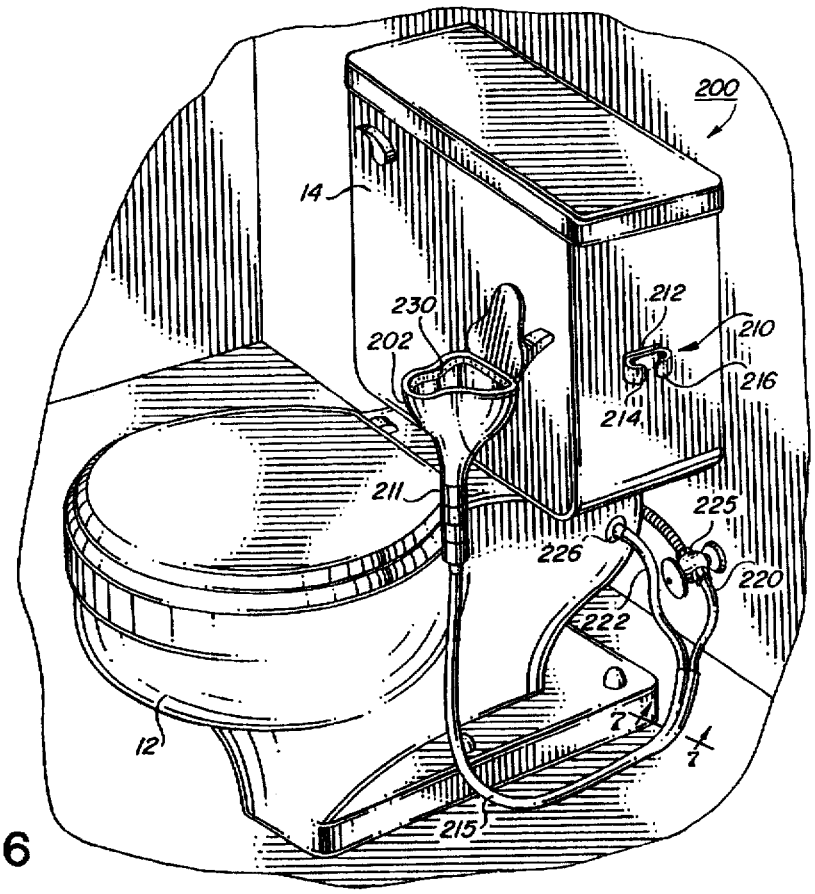
FIG. 6 is a perspective view of yet another embodiment of a urinal according to the present invention.

FIG. 6 illustrates another embodiment of the present invention and which is generally designated by the numeral 200. Urinal 200 is shown in conjunction with a conventional toilet having a tank 14 and bowl 12 as has been previously described. The urinal has a urinal bowl 202 in the general configuration as previously described with respect to FIG. 1. The bowl 202 is generally funnel shaped diverging downwardly to a handle section 211. The urinal bowl is removably supported by a hanger 210 having a mounting clip 212 which may be securable to the side of the toilet tank. Clip 212 may be adhesively secured to the toilet tank or may be secured by means of a suction cup or other conventional expedient. The clip includes a pair of arms 214 and 216 which are generally C-shaped and are adapted to engage and support the urinal bowl in the area above the handle 211. Flushing water is communicated to the urinal bowl and waste is carried from the urinal bowl by conduit 215. Conduit 215, as seen in FIG. 7, defines separate lines 220 and 222, for flushing water and waste disposal, respectively. Conduit 215 is split towards its distal end with line 220 connected to the water line at fitting 225. Line 222 is connected to the toilet at connection 226 which may be a quick connect coupling which communicates with the sewer past the toilet trap. Alternatively, flushing water supply may be provided to the urinal bowl 202 directly from the toilet tank as shown in FIG. 4.

Figure 8:
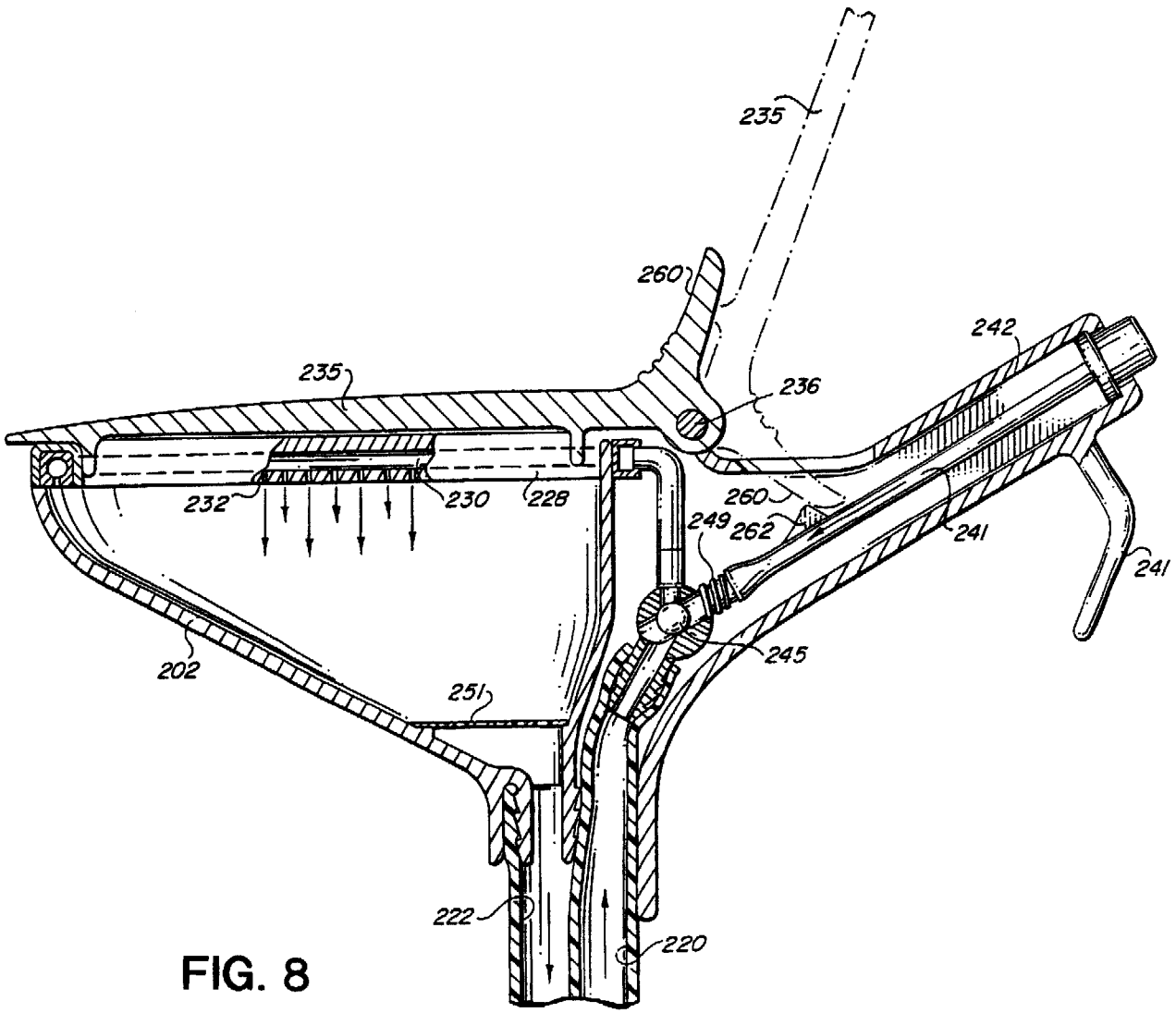
FIG. 8 is a sectional view of the urinal bowl shown in FIG. 6 in a closed position with the open position shown in dotted.
Figure 9:
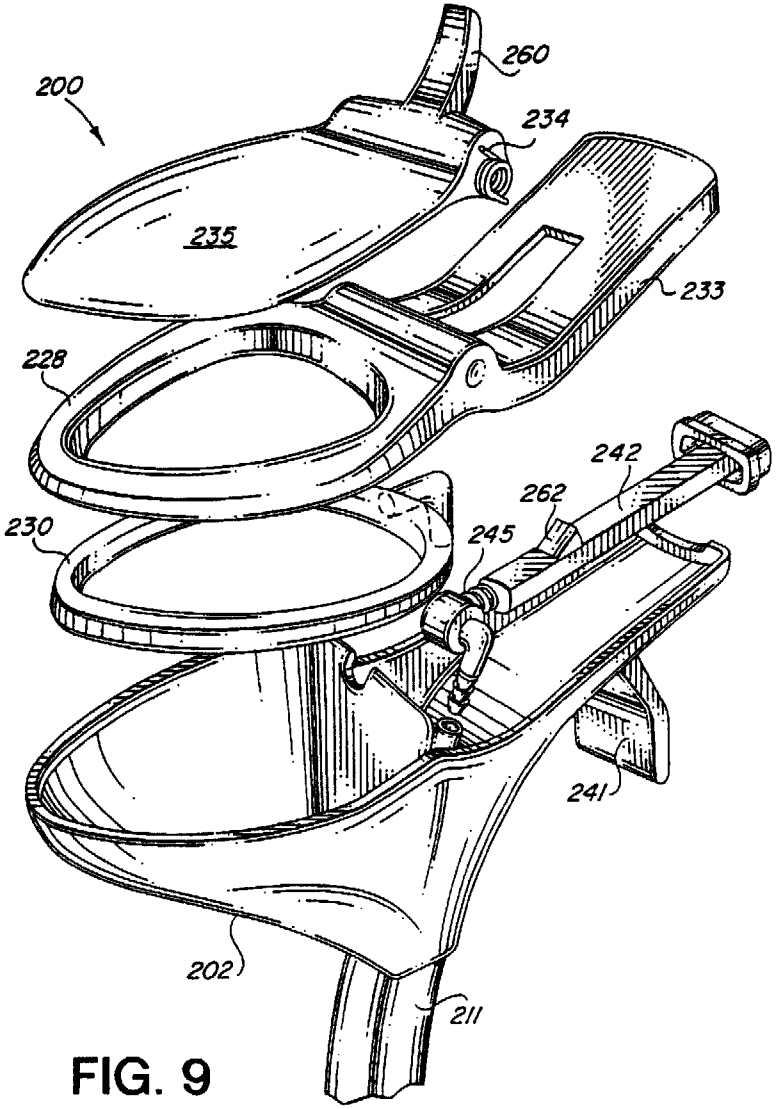
FIG. 9 is an exploded view of the urinal of FIG. 8.

The urinal bowl of FIG. 6 is shown in detail in FIGS. 8 and 9. A flush ring 230 extends interiorly of the bowl adjacent the upper edge of the bowl. The flush ring 230 is provided with a series of orifices 232 which direct rinse water downwardly along the interior surfaces of the bowl. The flush ring is received with annular rim 228 which has a rearwardly extending housing section 233. The cover 235 is configured in the general shape of the upper edge of the bowl and is pivotally secured at pivot 236 to the rear of the rim 228. An L-shaped handle 241 is secured to the rearward extension 242 of the bowl. When it is desired to use the device, the bowl is removed from the bracket 210, the user grasping the device at the handle 211 with one hand and with the other pivoting the cover 235 to the open position shown in dotted in FIG. 8 placing the device in a use position. When the use of the device is completed, the device may be returned to the bracket 210 and the cover closed. The bowl is re-used by actuation of flush valve 245. Depressing plunger 241 will open valve 245 against spring 249 admitting water to the flush ring from line 220. Fluid is discharged from the bowl across grate 251 into waste line 222 and to the sewer.

It will be obvious that the embodiment shown in FIGS. 6 to 9 may be mounted on a support 210 located on a wall or fixture adjacent the toilet instead of a location on the toilet tank as seen in FIG. 6. The device may also be hung at any convenient location by handle 241.

Figure 10:
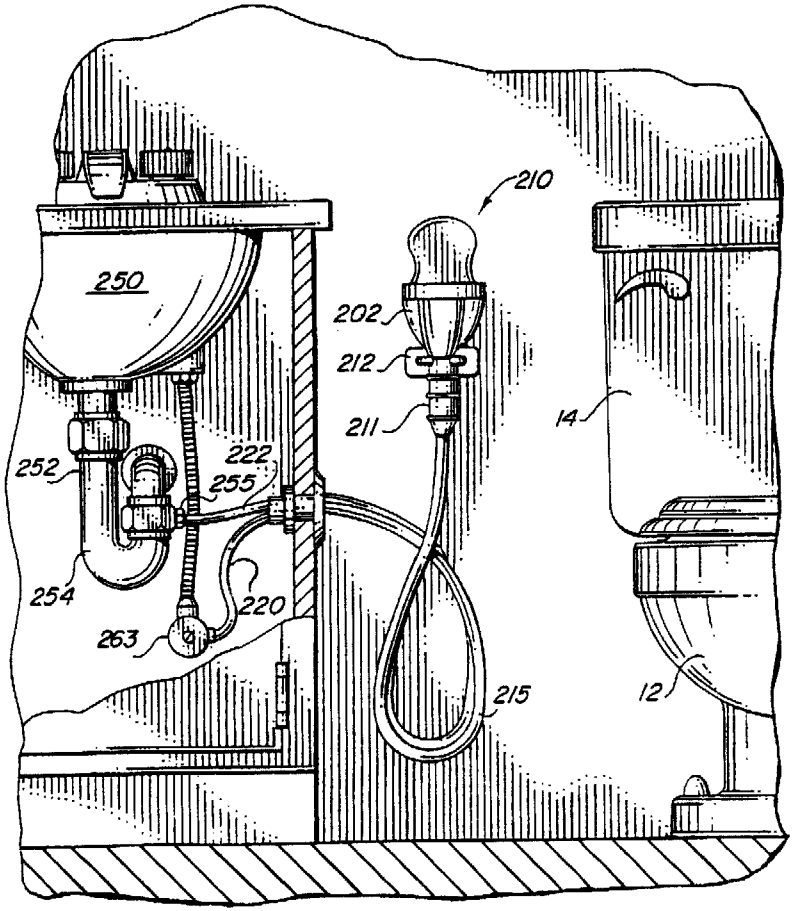
FIG. 10 is a front view of a urinal of the type shown in FIGS. 8 and 9, wall mounted and adjacent a toilet and plumbed to the waste line and water supply of an adjacent wash basin.

In FIG. 10, the urinal bowl 202 is constructed as has been described with reference to FIGS. 8 and 9 having a general funnel shape converging downwardly to a handle 211. The device is suspended from a bracket 212 positioned adjacent the toilet tank 14 and toilet bowl 12 next to a wash basin 250. The water and waste lines 220 and 222 are again housed within a single conduit 215. The distal ends of the conduit are separated into lines 220 and 222. Line 222 is connected to the waste line 252 at a location downstream of the trap 254. A conventional plumbing connection 255 is provided for this purpose. Similarly, water supply line 220 is connected to a tee 263 which connects the faucet of the wash basin to a conventional water supply line.

The device of FIGS. 8 and 9 also provide an automatic flushing cycle when the cover 235 is opened for use. The rear of the cover has a lever arm 260 which rotates to the position shown in dotted lines in FIG. 8 when the cover is opened. This brings the lever into engagement with cam 262 on plunger 242 causing the water valve to be opened. Closing the cover after use will allow the plunger to return to a non-actuated closed position.

Figure 12:
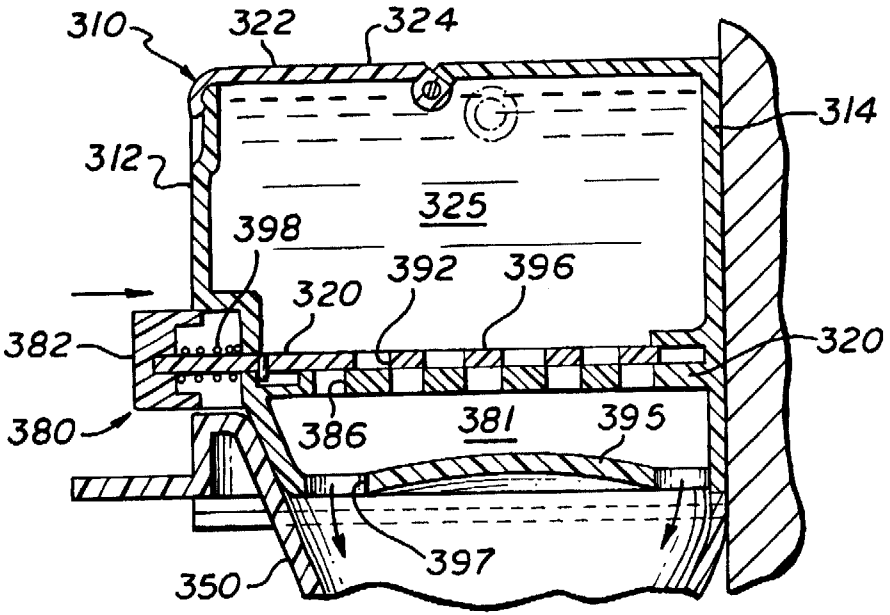
FIG. 12 is a cross-sectional view taken along line 12—12 of the urinal shown in FIG. 11.

FIGS. 11 through 14 show still another embodiment of the water saving urinal device of the present invention which is generally designated by the numeral 300. The device may be mounted on any surface adjacent a waste line and is shown mounted on wall 302 adjacent wash basin 304 which basin has a waste line 306 which connects to a sewer. The device 30 has a water-containing housing 310 which may be of any convenient shape but is shown as being generally rectangular in cross section and having side walls 312, 314, a rear wall 316, front wall 318 and a bottom wall 320 which define reservoir 325. A cover 322 extends across the upper surface of the housing 310. The cover 322 may include a hinged lid portion section 324 which may be pivoted upwardly to provide access to the water-containing reservoir 325. As best seen in FIG. 12, reservoir 325 may be manually filled by lifting cover 324 and transferring water from a nearby source such as a basin faucet by use of a cup or container. Alternatively, as illustrated in FIG. 13A, reservoir 325 may be directly connected to a water source across a fill valve 330 which has an actuator 331 which may be manually depressed against spring 332 to align inlet port 314 with the water supply connected to fitting 335. Alternately, valve 330 may be a conventional float type valve which will maintain a constant fluid level in the reservoir 325.

The housing has a pair of opposed depending flanges 340 and 342 extending along the opposite sides of the bottom wall 320. The flanges each have an inwardly extending leg 344 which defines rearwardly extending legs which form a hanger for the urinal bowl 350.

The urinal bowl 350 is shown as being generally funnel-shaped or conical having a drain outlet 352 at its lower end which is connected to a flexible drain line 354 which, in turn, is connected to the sewer 306 across a conventional trap 355. The connector 500 is described in detail hereafter. The upper edge of the urinal bowl has a peripheral lip 360 which is slidably engageable within the flanges 340 and 342. Thus, in the "parked" position, the bowl may be fully inserted beneath the reservoir housing and in the use-position may be withdrawn. The insertion, removal and use of the urinal bowl is facilitated by the forwardly extending tab 370 which may be conveniently grasped by the user.

FIG. 12 shows a cross section of the receptacle and a portion of bowl 350 with the bowl in the parked or engaged position. The water reservoir 325 contains a quantity of flushing water which may be distributed into the bowl by operating valve 380 by depressing button 382 located on the front of the housing. A chamber 381 is disposed within the housing below the water-containing reservoir 325. The chamber 381 is provided with one or more orifices 386 located in the bottom wall 320 which will serve to direct water to the interior wall of the funnelshaped bowl when it is engaged in a parked position. Depression of operator button 382 will move slide plate 396 rearwardly to bring orifices 392 in the slide plate in registry with orifices 386 in the plate 320. When the button is released, biasing spring 398 will return the slide plate to its normal non-actuated position. Water flowing into chamber 381 will be directly along the side walls of the bowl 350 by peripheral openings 397 in foraminous baffle plate 345.

FIG. 15 shows yet another embodiment of the present invention designated by the numeral 400. In this embodiment, housing 402 is of any convenient shape having a side wall 406, and a bottom wall 410. Flanges 412 extend downwardly from the side wall 406 at opposite sides to receive the urinal bowl 450 when it is in the parked position. The urinal bowl 450 may be generally funnel shaped or bowl-shaped as shown and communicates with an outlet fitting 420 and waste line 422 which may be connected to any suitable waste discharge location.

Figure 12A:
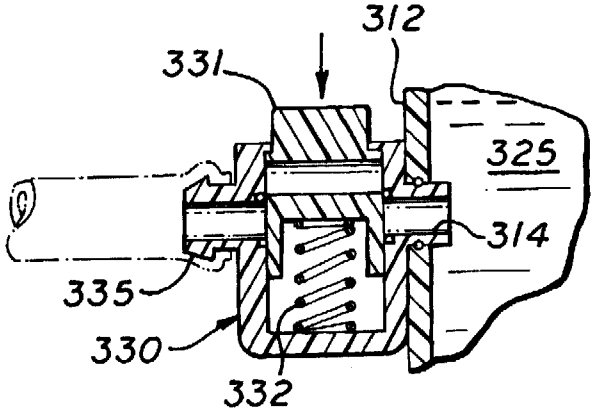
FIG. 12A shows an alternate valve for use with the embodiment of FIG. 11 when connected to a water supply.

The housing 402 defines an internal water reservoir 425. A cover 426 extends over the reservoir and has a pivotal lid portion 428 which may be opened so that the reservoir may be manually filled with a flushing water supply. Alternately, as has been described with reference to FIG. 12A, the reservoir may be connected to a source of supply water across a suitable water supply valve.

A discharge chamber 428 is located below the water reservoir 425 and has a generally foraminous concave wall 430 which serves as a distributor for water released into the chamber 428. Orifices 431 are located along the opposite edges of wall 430 to direct water onto the interior walls of the subjacent urinal bowl 450.

Figure 15A:
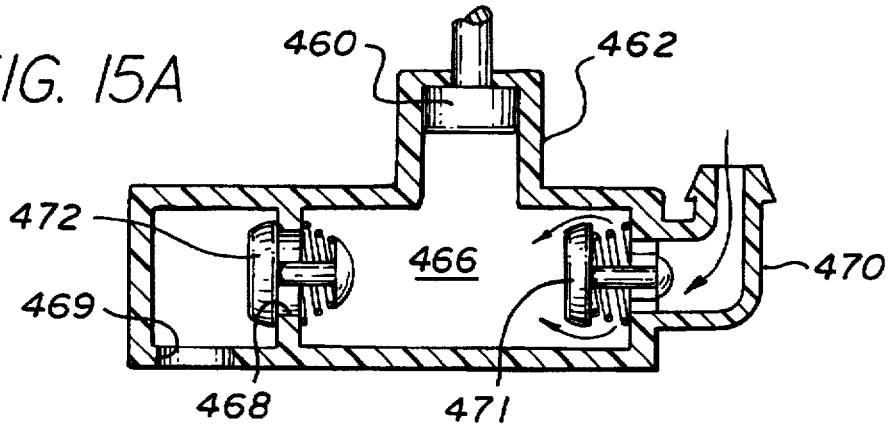
FIG. 15A is a detail cross-sectional view of the pump chamber shown in FIG. 15.

The advantage of the embodiment shown in FIGS. 15 and 15A is that it will deliver pressurized fluid for rinsing and washing the bowl. This is accomplished by a pump assembly 451 which has a upwardly extending plunger 452 which terminates at an operating button 454 in the top wall 426. The plunger is upwardly biased by spring 455. The lower end of the plunger carries a small piston 460 which is received within the chamber 462. Chamber 462 communicates with delivery chamber 466. Delivery chamber 466 has an outlet port 468 which communicates with subjacent chamber 428 across port 469. Chamber 466 also communicates with reservoir 425 via passageway 470. A one-way check valve 471 allows flow from the reservoir 425 into the chamber 466. Similarly, a one-way check valve 472 allows flow from chamber 466 into subjacent chamber 428 when chamber 466 is pressurized sufficiently to open the check valve 472.

In operation, plunger 452 is operated by the user manually pushing down on button 454. Chamber 466 has been filled with fluid from chamber 425 via passageway 470. When plunger 452 is depressed, the fluid within chamber 466, being essentially non-compressible, will cause the valve 472 to open. Piston 460, as it is further depressed, will force fluid through port 469 to be distributed by plate 430 through orifices 431 peripherally arranged about the plate. This water will be passed along the interior walls of the urinal to the drain to flush and clean the urinal bowl.

Figure 11:
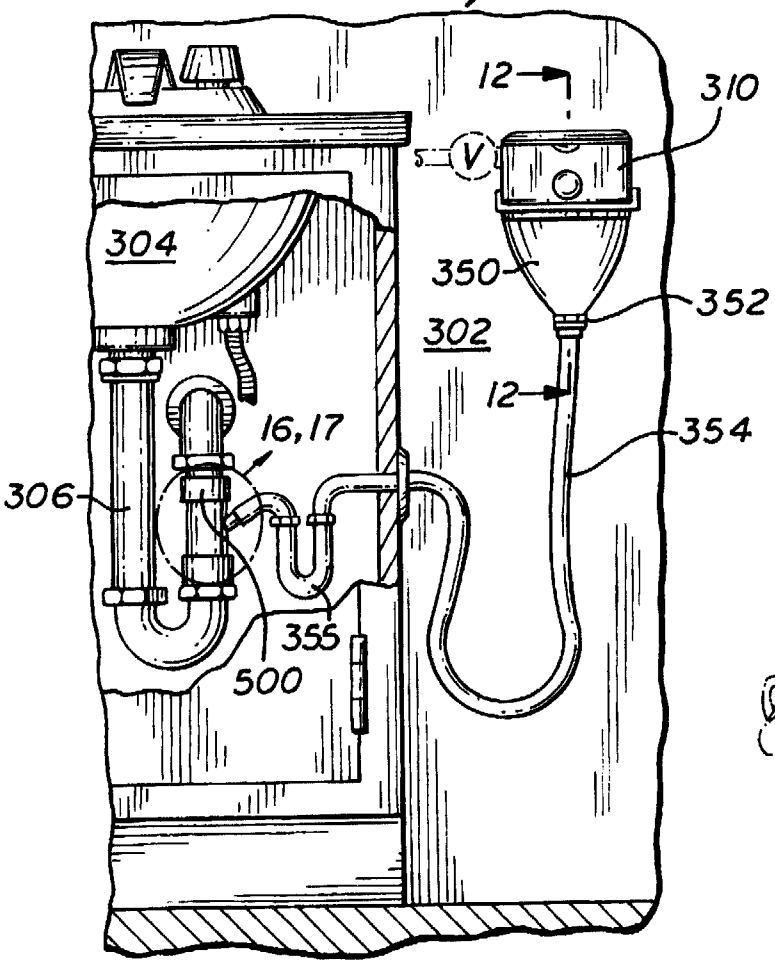
FIG. 11 is a front view of yet another embodiment of the invention shown wall-mounted adjacent a sink and waste line.
Figure 13:
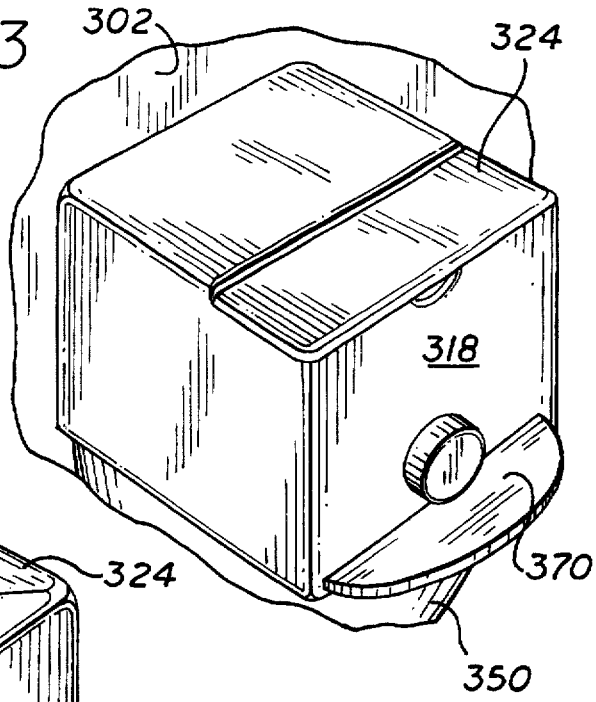
FIG. 13 is a perspective view of the urinal shown in FIG. 12.
Figure 14:
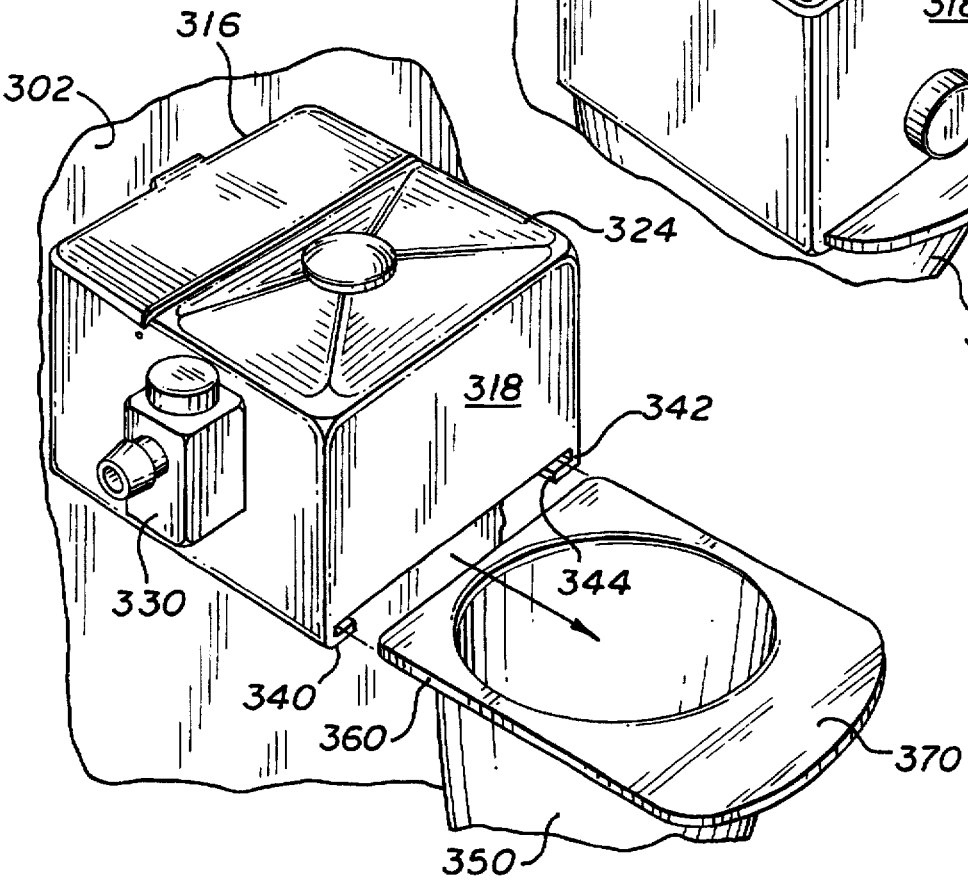
FIG. 14 is a perspective view of a urinal of the type shown in FIG. 12A.

As indicated above, as for example in FIG. 11, the system of the present invention may be connected to a suitable drain or sewer which allows the unit to be placed adjacent an existing sink or wash basin. Building codes of many areas often do not permit direct connection to a sewer waste line simply by drilling or tapping into the line. Accordingly, it may be necessary to use an approved connector for this purpose.

Turning to FIGS. 16 and 17, a connector is shown which is generally designated by the numeral 500 which may be used in connection with sewer pipes of several diameters. In most localities, sewer pipes have an OD of either 1.5" or 1.9". The connector 500 has a cylindrical main body section 502 which has an interior diameter which closely corresponds to a first lesser diameter, as for example the diameter of 1.5" OD pipe. This allows a 1.5" OD pipe to be engaged with the body section 502 as shown in FIG. 17. The abutting pipe sections 510 and 512 are slightly spaced apart when the connection is made. An angular connector 525 extends from the body section having a tapered end 526 and adjacent annular groove 528 so that a flexible waste line may be secured about the connector and held in place by an annular clamp positioned in an annular groove area 528.

The connector 500 is provided with opposite flange sections 530 and 532, each of which have an internal diameter which corresponds to or is slightly larger than a second, larger diameter, as for example the diameter of 1.9" OD pipe. Thus, if the connector is to be used with two sections of larger diameter pipe, the larger diameter pipe will be seated within the flanges 530, 532. If, on the other hand, the adaptor is to be inserted between a first, larger pipe section such as 1.9" OD pipe section 560 as shown in FIG. 16 and a smaller diameter pipe such as pipe section 562 as seen in FIG. 16, the adaptor accommodates such adjoining. Larger pipe section 560 is inserted within the flange section 532 and the smaller diameter pipe section 562 is inserted so that it is engaged within the body section 502. Preferably, the connector is made of a suitable plastic such as PVC and the connections can be made in conventional manner using PVC cement.

The device of the present invention may be mounted on either side of the toilet bowl at the preference of the user or dual devices may be provided at opposite sides of the bowl to provide "his" and "her" units. The device is easily used and may be grasped and adjusted to accommodate users of all ages and physical sizes. The construction, being primarily plastic, is durable, rust-resistant, inexpensive and may be provided as either an OEM product or as an aftermarket modification.

Other significant benefits result from use of the present invention. The use of the urinal will help avoid the male "seat down" controversy and, accordingly, will help in maintaining the toilet seat in a dry, sanitary condition. Soiling of carpet, flooring and clothing is less likely and embarrassing noise is also reduced.

Thus, will be seen from the foregoing that the present invention provides a unique, new and novel low-water volume urinal. The device is easy and convenient to install and may be mounted on either side of a conventional toilet. The device can be made from various materials but is preferably fabricated with the primary component such as the urinal bowl, housing, tubing and fittings fabricated from plastic for ease of maintenance. It is understood that the present embodiments as described above are to be considered as illustrative and not restrictive.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

We claim:

1. A urinal for use in connection with a sewer line, said urinal comprising:

(a) a urinal bowl, said bowl having an open top with a peripheral edge and a discharge at a lower end;

(b) a flexible waste line extending from the discharge of the urinal bowl and communicating with the sewer line;

(c) a hanger housing mountable on a fixture, said hanger having a side wall and a bottom wall defining a water reservoir and having hanger means for engaging the said urinal bowl whereby the urinal bowl may be maintained in a stored position with said bowl in a generally horizontal position below the reservoir and may be manually moved from the hanger to a position of use;

(d) means for flushing said bowl including a valve operable to direct discharge water from the said reservoir to the interior of said bowl; and (e) a foraminous distribution plate disposed below said bottom wall which is positioned above said urinal bowl when the bowl is in a stored position and valve means operable to discharge water from said reservoir onto said distributor plate.

2. The urinal of claim 1 wherein said bowl is provided with a peripheral lip and wherein said hanger has flanges associated therewith to receive said lip.

3. The urinal of claim 1 wherein said bowl is provided with handle means.

4. The urinal of claim 1 wherein said housing is provided with a top having an openable cover.

5. The urinal of claim 1 further including pump means for manually pressurizing the discharge of water from said reservoir.

6. A urinal for use in connection with a sewer line, said urinal comprising:

(a) a urinal bowl, said bowl having an open top with a peripheral edge and a discharge at a lower end;

(b) a flexible waste line extending from the discharge of the urinal bowl and communicating with the sewer line;

(c) a hanger housing mountable on a fixture, said hanger having a side wall and a bottom wall defining a water reservoir and having hanger means for engaging the said urinal bowl whereby the urinal bowl may be maintained in a stored position with said bowl in a generally horizontal position below the reservoir and may be manually moved from the hanger to a position of use;

(d) means for flushing said bowl including a valve operable to direct discharge water from the said reservoir to the interior of said bowl; and (e) pressure means for manually pressurizing the discharge water from said reservoir.

7. The urinal of claim 6 wherein said pressure means comprise a chamber communicating with said reservoir across a first check valve and communicating with said bowl across a second check valve and piston means operably communicating with said chamber operable to open said second check valve and discharge fluid thereacross.

8. A urinal for use in connection with a sewer line, said urinal comprising:

(a) a urinal bowl, said bowl having an open top with a peripheral edge and a discharge at a lower end;

(b) a flexible waste line extending from the discharge of the urinal bowl and communicating with the sewer line;

(c) a hanger housing mountable on a fixture, said hanger having a side wall and a bottom wall defining a water reservoir and having hanger means for engaging the said urinal bowl whereby the urinal bowl may be maintained in a stored position with said bowl in a generally horizontal position below the reservoir and may be manually moved from the hanger to a position of use;

(d) means for flushing said bowl including a valve operable to direct discharge water from the said reservoir to the interior of said bowl; and (e) connector means in said sewer line attachable to said flexible waste line, said connector means comprising a body having an end and having a first diameter, flanges at the end of the body having a second larger diameter and attachment means for connecting a line to said connector.

* * * * *